US006109233A

United States Patent [19]

Jutz

[11] Patent Number: 6,109,233

[45] Date of Patent: Aug. 29, 2000

[54] CYLINDERHEAD OF A MULTI-CYLINDER INTERNAL COMBUSTION ENGINE

[75] Inventor: Bernhard Jutz, Burgstetten, Germany

[73] Assignee: DaimlerChrysler AG, Stuttgart, Germany

[21] Appl. No.: 09/370,195

[22] Filed: Aug. 9, 1999

[30] Foreign Application Priority Data

Aug. 12, 1998 [DE] Germany ..... 198 36 441

[51] Int. Cl.[7] ..... F02F 1/36

[52] U.S. Cl. ..... 123/193.5; 123/41.82 R

[58] Field of Search ..... 123/193.5, 193.1, 123/41.82 R

[56] References Cited

U.S. PATENT DOCUMENTS 4,641,609 2/1987 Tanaka ..... 123/41.82 R 5,873,331 2/1999 Jutz ..... 123/193.5

5,964,196 10/1999 Sigle et al. ..... 123/193.5

FOREIGN PATENT DOCUMENTS 35 13 126 10/1986 Germany .

197 13 246 1/1999 Germany .

*Primary Examiner*—Marguerite McMahon

*Attorney, Agent, or Firm*—Klaus J. Bach

[57] ABSTRACT

In a cylinder head for a multi-cylinder internal combustion engine comprising a casting having bottom top and side walls delimiting a cooling water space and tubular cylinder head bolt columns extending along the side walls, and transverse walls extending between opposite cylinder head bolt columns, the tubular cylinder head bolt columns have, adjacent the bottom wall, separating wall sections which are relatively thin so that they do not transmit cylinder head clamping forces to an engine block to which the cylinder head is bolted.

7 Claims, 1 Drawing Sheet

CYLINDERHEAD OF A MULTI-CYLINDER INTERNAL COMBUSTION ENGINE

BACKGROUND OF THE INVENTION

The invention relates to a multi-cylinder internal combustion engine consisting of a casting including a cooling water space, which is delimited by bottom top and side walls and through which inlet passages extend from one side wall to combustion chambers for the cylinders of the engine and from the combustion chamber to the opposite side wall and which includes tubular columns which extend from the top wall along the cylinder head side walls and between which transverse walls are disposed.

DE A 35 13 126 discloses a cylinder head wherein reinforcement walls extend between the cylinder head bottom and the cylinder head top and are joined to tubular columns for receiving cylinder head bolts.

DE 197 13 246 (U.S. Pat. No. 5,873,331) discloses a cylinder head, wherein a predetermined distribution of the cylinder head bolt forces and of the engagement forces of the cylinder head with the engine block especially over the circumference of each combustion chamber is obtained. In the arrangement described, the reinforcement walls extend between adjacent bolt columns along the circumference of each combustion chamber. In the longitudinal and the transverse direction of the cylinder head and adjacent the bolt columns the reinforcement walls are recessed so as to be spaced from the cylinder head bottom wall.

Since also the bolt columns do not extend fully to the cylinder head bottom wall, the bolt forces are distributed mainly to the longitudinal and transverse walls around the combustion chambers, whereby an optimal engagement of the cylinder head with the engine block along the circumference of each combustion chamber is achieved.

Furthermore, the side edges of the inner transverse walls may be inclined inwardly toward the cylinder head in order to improve the engagement of the cylinder head bottom wall with the engine block between adjacent combustion chambers. The length of bolt columns may be ⅔ of the distance between the bottom and the top of the cylinder head so that the cylinder head bolts are partially exposed to the cooling water of the engine.

It is the object of the present invention to provide a cylinder head for a multi-cylinder internal combustion engine, wherein uniform engagement of the cylinder head with the engine block is achieved and, furthermore, the cylinder head bolts are protected from contact with the cooling water. In this respect, the arrangement as proposed in the earlier DE 197 13 246 for the side walls and the transverse walls is to be maintained to provide the desired force transmission.

SUMMARY OF THE INVENTION

In a cylinder head for a multi-cylinder internal combustion engine comprising a casting having bottom top and side walls delimiting a cooling water space and tubular cylinder head bolt columns extending along the side walls and transverse walls extending between opposite cylinder head bolt columns, the tubular cylinder head bolt columns have, adjacent the bottom wall, separating wall sections which are relatively thin so that they do not transmit cylinder head clamping forces to an engine block to which the cylinder head is bolted.

The invention resides in the concept of protecting the cylinder head bolts in the areas where they are not surrounded by the tubular cylinder head bolt columns by a divider wall which however does not transmit any forces. This divider wall can be an integral part of the cylinder head bolt columns, but it must not have any force transmitting functions as far as forces generated by the cylinder head bolt are concerned.

The divider wall function may also be fulfilled by a sleeve, which covers the bolt in the area where the column wall is omitted and which is sealed at the bottom of the cylinder head.

In order to facilitate a transverse cooling water flow in the cooling water spaces for the individual combustion chambers, the transverse walls may extend with their edges all the way between the top and the bottom of the cylinder head. However, in order to omit any force transfer by the transverse walls to the cylinder head in the areas adjacent the cylinder head bolts, the transverse wall areas adjacent the cylinder head bolts may also be so designed that they do not transmit any appreciable forces. This can be achieved by making these wall areas relatively thin. Alternatively, an additional structure such as guide baffles may be provided in the areas where the wall sections are omitted.

With a complete separation of the cylinder head bolts from the cooling water spaces, a closed annular space can be formed around each cylinder head bolt. In this way also, an advantageous temperature distribution over the full length of the cylinder head bolts can be obtained, particularly during engine warm up after a cold start.

The invention will be described below in greater detail on the basis of the accompanying drawing.

DESCRIPTION OF A PREFERRED EMBODIMENT

Figure 1:
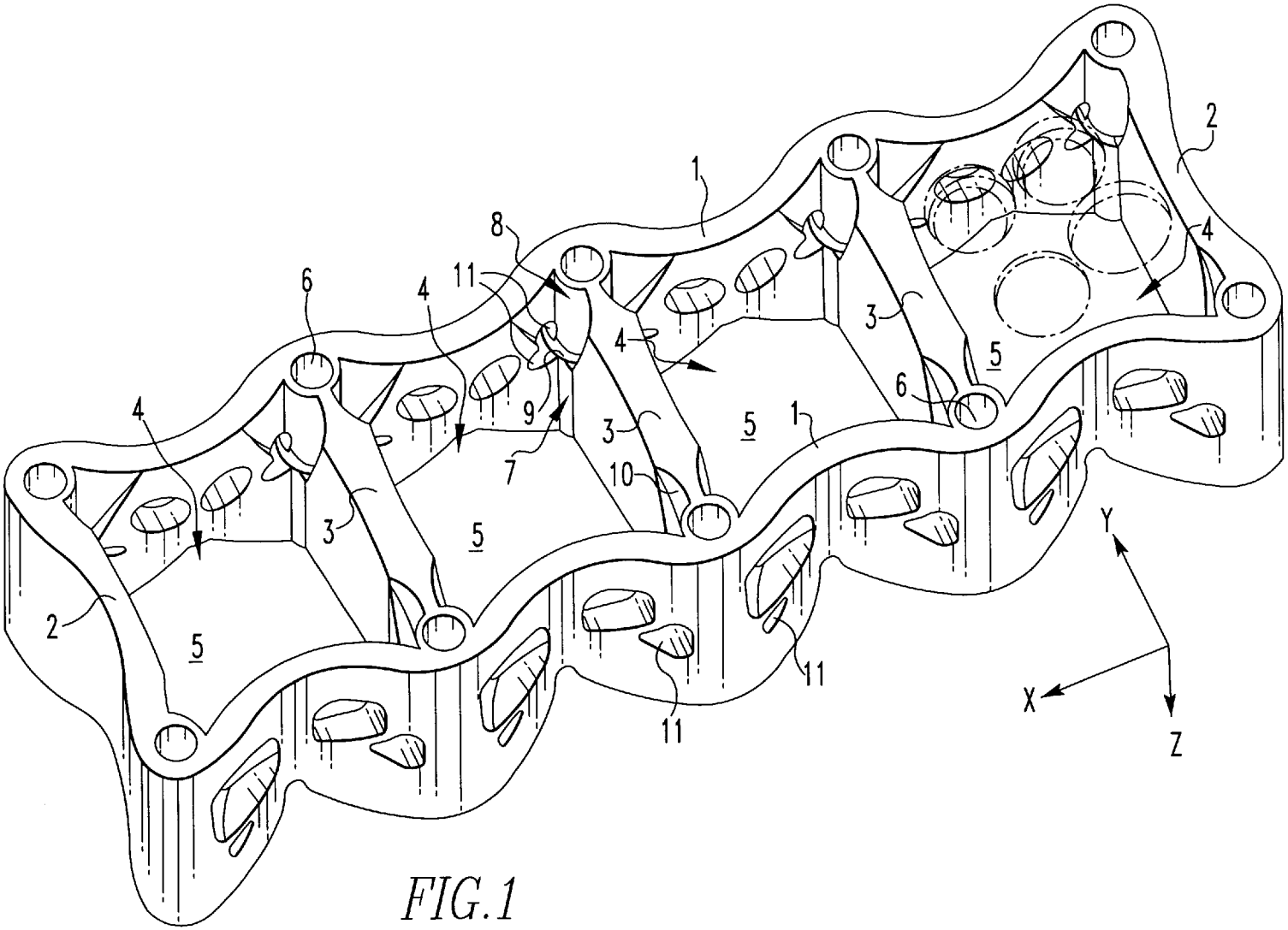
FIG. 1, which is the sole FIGURE, is a perspective view of a portion of a cylinder head showing the lower part of the cylinder head to be mounted onto the engine block.

The cylinder head portion shown in the FIGURE has longitudinal side walls 1 and transverse walls 2, 3 of which define water spaces in the cylinder head. The water spaces extend from the bottom wall of the cylinder head in the areas around the cylinders underneath essentially up to the top of the cylinder head which, in the FIGURE is at the lower side. The transverse walls 2 are outside walls and the transverse walls 3 are intermediate walls disposed between adjacent cooling water spaces 4. The cooling water spaces 4 are closed in an upper part of the cylinder head by a common cover 5.

Intake and exhaust passages extend through the longitudinal side walls 1 in the bottom part of the cylinder head and lead to the intake and exhaust valves, respectively. Such penetration is indicated in the FIGURE by openings in the side walls 1. In the jointure area between the longitudinal side walls 1 and the transverse walls 2, 3, there are arranged the tubular columns 6 for receiving and guiding the cylinder head bolts by which the cylinder head is mounted onto the engine block.

The bolt-receiving tubular columns 6 extend from the upper area of the cylinder head over a first distance 7 with a first wall thickness and then over a second distance 8 with a second wall thickness up to the bottom of the cylinder-head. Between the first and second wall thickness lengths 7 and 8 of the tubular columns, there is a step 9.

The thick wall area in the first length 7 is capable of transmitting the pressure forces generated by the cylinder head bolts. The thin wall area in the second length 8, only fulfills the function of a non-supporting divider wall separating the interior of the tubular columns 6 from the surrounding cooling water spaces 4. The thin wall in the second length 8 is not strong enough to transmit substantial pressure forces. Rather, it is so dimensioned that it cannot transmit the clamping forces generated by the cylinder head bolts. The wall thickness of the tubular columns over the second length 8 is preferably so selected that any clamping forces generated by the cylinder head bolts are transmitted solely by the longitudinal side walls 1 and the transverse walls 2, 3 in such a way as if the tubular column walls in the distance 8 would not exit.

In the embodiment shown in the FIGURE, the wall areas of the tubular columns 6 in the length areas 8, which have only divider wall functions are formed integrally with the longitudinal side walls 1 and the transverse walls 2, 3, the part shown in the FIGURE being a single casting. The wall thicknesses of the tubular columns over the length 8 are so thin such that their manufacture in a casting is just possible.

However, over the length 8 the column portions may also be formed by separately inserted parts such as sleeves consisting of a suitable material capable of withstanding the operational conditions. The sleeves must be sealed with respect to the column walls of the length 7 and with respect to the cylinder head bottom so as to fulfill the function of separating the interior of the tubular cylinder head bolt columns 6 from the adjacent cooling water spaces. Such separation should be maintained since the cylinder head bolts are under high stresses and could be detrimentally affected by exposure to the cooling water so that their strength could suffer over time. Cylinder head bolts, which are exposed to cooling water, need to be made of a special relatively expensive material. It is desirable to avoid the need for cylinder head bolts of such expensive materials for economic reasons. The arrangement according to the invention, whereby the cylinder head bolts are separated from the cooling water, eliminates the need for expensive cylinder head bolts.

For an optimal transmission of the compression forces generated by the cylinder head bolts to the engine block, the side and transverse wall areas directly adjacent the cylinder head bolts should not be capable of transmitting the cylinder head bolt forces. Therefore, in those areas, the walls have cutouts as disclosed in U.S. Pat. No. 5,873,331. Such wall cutouts, however, permit cooling water to flow from one of the cooling water spaces 4 to the other. In cases in which it is desirable that the cooling water flows only transversely through the individual cooling water spaces 4, the cutouts are not acceptable. In those cases, the desirable cutouts are closed only to such an extent as it is necessary to achieve separation between the cooling water spaces 4. This means that the wall thicknesses in those areas should be very small as indicated in the FIGURE by the numeral 10 so that the cylinder head bolt compression forces transmitted by these wall areas are negligible.

The inner diameter of the tubular cylinder head bolt columns 6 may be sufficiently large so that an annular space remains between the walls of the tubular columns 6 and the cylinder head bolt when the bolt is inserted.

The cooling water is supplied to the individual cooling water spaces 4 and removed therefrom through openings 11 formed in the longitudinal side walls 1.

What is claimed is:

1. A cylinder head for a multi-cylinder internal combustion engine comprising a casting having bottom, top and side walls delimiting a cooling water space through which intake and exhaust passages extend, and tubular cylinder head bolt columns extending from said top wall along the cylinder head side walls, and transverse walls extending between opposite cylinder head bolt columns including, adjacent said bottom wall, thin-walled sections forming separating walls of a thickness which is insufficient to transmit clamping forces of the respective cylinder head bolts to an engine block onto which said cylinder head is bolted.

2. A cylinder head according to claim 1, wherein said separating walls extend along said cylinder head bolt columns from said bottom wall about one third of the axial length of said cylinder head bolt columns.

3. A cylinder head according to claim 1, wherein said transverse walls separate adjacent cooling water spaces and have, at their end areas adjacent said cylinder head bolt columns and adjacent said bottom wall, a wall thickness which is insufficient to transmit clamping forces of the respective cylinder head bolts to an engine block onto which said cylinder head is bolted.

4. A cylinder head according to claim 1, wherein said thin-walled separating wall sections of said cylinder head bolt columns are formed by separate parts which are sealingly mounted in the area of said cylinder head bolt columns adjacent said bottom wall.

5. Cylinder head according to claim 4, wherein said separate parts consist of a material, which is different from that of which said cylinder head bolt column consists and which is capable of withstanding the operational conditions in the engine.

6. A cylinder head according to claim 5, wherein said separate parts are sleeves.

7. A cylinder head according to claim 1, wherein said tubular cylinder head column has a diameter greater than said cylinder head bolt so as to provide a sealed annular space around said cylinder head bolt.

* * * * *